US012550936B2

(12) United States Patent
Yim

(10) Patent No.: US 12,550,936 B2
(45) Date of Patent: Feb. 17, 2026

(54) AEROSOL-GENERATING DEVICE WITH MOVABLE UPSTREAM COVER AND DOWNSTREAM COVER

(71) Applicant: Philip Morris Products S.A., Neuchatel (CH)

(72) Inventor: Jun Wei Yim, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 415 days.

(21) Appl. No.: 18/255,616

(22) PCT Filed: Dec. 2, 2021

(86) PCT No.: PCT/EP2021/083884
§ 371 (c)(1),
(2) Date: Jun. 2, 2023

(87) PCT Pub. No.: WO2022/122524
PCT Pub. Date: Jun. 16, 2022

(65) Prior Publication Data

US 2024/0099369 A1 Mar. 28, 2024

(30) Foreign Application Priority Data

Dec. 7, 2020 (EP) ..... 20212221

(51) Int. Cl.
*A24F 40/40* (2020.01)
*A24F 40/20* (2020.01)
(Continued)

(52) U.S. Cl.
CPC ..... *A24F 40/40* (2020.01); *A24F 40/53* (2020.01); *A24F 40/60* (2020.01); *A24F 40/85* (2020.01); *A24F 40/20* (2020.01)

(58) Field of Classification Search
CPC ..... A24F 15/015; A24F 40/40; A24F 40/53; A24F 40/60; A24F 40/85; A24F 40/20
See application file for complete search history.

(56) References Cited

U.S. PATENT DOCUMENTS

2014/0182608 A1 7/2014 Egoyants et al.
2021/0137163 A1 5/2021 An

FOREIGN PATENT DOCUMENTS

CN 107713019 A 2/2018
CN 111050580 A 4/2020
(Continued)

OTHER PUBLICATIONS

Japanese Office Action issued Jul. 2, 2024 in Japanese Patent Application No. 2023-534298, 3 pages.
(Continued)

*Primary Examiner* — Michael H. Wilson
*Assistant Examiner* — Jennifer A Kessie
(74) *Attorney, Agent, or Firm* — Oblon, McClelland, Maier & Neustadt, L.L.P.

(57) ABSTRACT

An aerosol-generating device is provided, including: a cavity including a downstream opening for receiving an article and an upstream opening; a movable downstream cover to cover the downstream opening; a movable upstream cover to cover the upstream opening; a cover moving element for one or more of: opening of the upstream cover upon one or both of opening of the downstream cover or insertion of the article into the cavity, closing of the upstream cover upon one or both of closing of the downstream cover or removal of the article, opening of the downstream cover upon one or both of opening of the upstream cover or insertion of the article, and closing of the downstream cover upon one or both of closing of the upstream cover or removal of the
(Continued)

article; and an upstream end face including the upstream opening and being slidable over the upstream end face.

20 Claims, 7 Drawing Sheets

(51) Int. Cl.

| | |
|---|---|
| ***A24F 40/53*** | (2020.01) |
| ***A24F 40/60*** | (2020.01) |
| ***A24F 40/85*** | (2020.01) |

(56) References Cited

FOREIGN PATENT DOCUMENTS

| | | | |
|---|---|---|---|
| EP | 3 711 519 | A1 | 9/2020 |
| JP | 2019-518421 | | 7/2019 |
| JP | 2019-205405 | A | 12/2019 |
| JP | 2020-80775 | A | 6/2020 |
| JP | 6707679 | B2 | 6/2020 |
| KR | 10-2018-0126603 | A | 11/2018 |
| RU | 2 665 438 | C1 | 8/2018 |
| RU | 2 713 476 | C1 | 2/2020 |
| RU | 2 722 929 | C2 | 6/2020 |
| WO | WO 2013/034456 | A1 | 3/2013 |
| WO | WO 2019/164135 | A1 | 8/2019 |
| WO | WO 2019/224120 | A1 | 11/2019 |

OTHER PUBLICATIONS

Combined Russian Decision to Grant and Search issued Nov. 8, 2023 in Russian Patent Application No. 2023114768/03 (with English translation), 20 pages.

International Search Report & Written Opinion issued Apr. 19, 2022 in PCT/EP2021/083884 filed on Dec. 2, 2021, 12 pages.

International Preliminary Report on Patentability issued Mar. 17, 2023 in PCT/EP2021/083884 filed on Dec. 2, 2021, 12 pages.

Japanese Decision to Grant issued Mar. 27, 2025 in Japanese Patent Application No. 2023-534298, 2 pages.

Korean Office Action issued Aug. 19, 2025, in corresponding Korean Patent Application No. 10-2023-7018759 (with English Translation), 9 pages.

AEROSOL-GENERATING DEVICE WITH MOVABLE UPSTREAM COVER AND DOWNSTREAM COVER

The present invention relates to an aerosol-generating device comprising a movable upstream cover for covering an upstream opening and a movable downstream cover for covering a downstream opening. The present invention further relates to an aerosol-generating system comprising the aerosol-generating device. The present invention further relates to a method of operating the aerosol-generating system.

Aerosol-generating devices are known which heat, but which do not burn, aerosol-forming substrates, such as tobacco, in aerosol-generating articles. Such devices heat the aerosol-forming substrates to a sufficiently high temperature for generating an aerosol for inhalation by the user. These aerosol-generating devices normally include a cavity for receiving the aerosol-generating article. The aerosol-generating article is normally inserted into the cavity via a downstream opening in the aerosol-generating device. The aerosol-generating devices also include air inlets for providing air-flow path through the device. These devices are typically portable, hand-held devices and are required to be compact.

Residue or debris from aerosol-forming articles deposit in the cavity of the aerosol-generating devices over time. This residue or debris can accidentally leave the aerosol-generating device, thereby unintentionally contaminating the outside of the device, for example pockets in which the aerosol-generating devices are transported. Aerosol-generating devices are known, which include doors for covering the openings. These doors have to be opened and closed by a user increasing the time required for operating the aerosol-generating device. Cleaning of the device also requires a user to manually open doors covering both a downstream opening and an upstream opening, which is laborious.

It would be desirable to provide an aerosol-generating device which can easily be operated without the requirement to manually open all doors. It would furthermore be desirable to provide an aerosol-generating device, wherein debris or residue deposited in the cavity of the device cannot unintentionally leave the device. It would furthermore be desirable to provide an aerosol-generating device, which can easily be cleaned with a reduced number of operating steps.

According to an embodiment of the present invention an aerosol-generating device is provided which may comprise a cavity for receiving an article, the cavity comprising a downstream opening for receiving the article and at least one upstream opening. The aerosol-generating device may comprise a movable downstream cover for covering the downstream opening. The aerosol-generating device may comprise a movable upstream cover for covering the at least one upstream opening. The aerosol-generating device may comprise a cover moving element which may be configured for one or more of:

- opening of the upstream cover upon one or both of: opening of the downstream cover or insertion of the article into the cavity, and
- closing of the upstream cover upon one or both of: closing of the downstream cover or removal of the article from the cavity,
- opening of the downstream cover upon one or both of: opening of the upstream cover or insertion of the article into the cavity, and
- closing of the downstream cover upon one or both of closing of the upstream cover or removal of the article from the cavity.

According to another embodiment, an aerosol-generating device is provided which comprises a cavity for receiving an article, the cavity comprising a downstream opening for receiving the article and at least one upstream opening. The aerosol-generating device comprises a movable downstream cover for covering the downstream opening. The aerosol-generating device comprises a movable upstream cover for covering the at least one upstream opening. The aerosol-generating device comprises a cover moving element configured for one or more of:

- opening of the upstream cover upon one or both of: opening of the downstream cover or insertion of the article into the cavity, and
- closing of the upstream cover upon one or both of: closing of the downstream cover or removal of the article from the cavity,
- opening of the downstream cover upon one or both of: opening of the upstream cover or insertion of the article into the cavity, and
- closing of the downstream cover upon one or both of closing of the upstream cover or removal of the article from the cavity.

The cover moving element may facilitate opening of one cover upon opening of the other cover. The insertion of an article into the cavity or the removal of an article from the cavity may also trigger the cover moving element. The cover moving element may then open or close either the upstream cover or the downstream cover simultaneously with a user opening the other cover. The cover moving element may facilitate the simultaneous opening of one cover when a user manually opens the other cover. Thus, there may be no need to manually operate both the downstream cover and the upstream cover. This may greatly ease operating the aerosol-generating device. The cover moving element may furthermore facilitate a simultaneous opening or closing of both covers. This may reduce the risk of debris deposited in the cavity from unintentionally leaving the device.

The cover moving element may also ease the opening of both the downstream cover and the upstream cover, so that the aerosol-generating device can easily be cleaned.

The cover moving element may be configured to both open and close one or both of the downstream cover and the upstream cover. The cover moving element may be configured to only close one or both of the downstream cover or may be configured to only open one or both of the downstream cover.

As used herein, the terms "upstream", and "downstream", are used to describe the relative positions of components, or portions of components, of the aerosol-generating device in relation to the direction in which air flows through the aerosol-generating device during use thereof along the air flow path. Aerosol generating devices according to the invention comprise a proximal end through which, in use, an aerosol exits the device. The proximal end of the aerosol generating device may also be referred to as the mouth end or the downstream end. The mouth end is downstream of the distal end. The mouth end may comprise a mouthpiece. The distal end of the aerosol generating device may also be referred to as the upstream end. Components, or portions of components, of the aerosol generating device may be described as being upstream or downstream of one another based on their relative positions with respect to the airflow path through the aerosol generating device.

The cover moving element may be configured for automatically opening or closing one or both of the upstream opening and the downstream opening.

The aerosol-generating device may comprise an upstream end face comprising the at least one upstream opening. The upstream cover may be configured to be slidable over the upstream end face.

A slidable upstream cover may allow a user to easily operate the upstream cover.

The aerosol-generating device may comprise a downstream end face comprising the downstream opening. The downstream cover of the aerosol-generating device may be configured to be slidable over the downstream end face.

This also may ease the operating of the downstream cover by a user.

Alternatively, one or both of the downstream cover or the upstream cover may be configured to be pivotable about a hinge. One or both of the downstream cover or the upstream cover may be connected to the aerosol-generating device by the hinge. Preferably, one or both of the downstream cover and the upstream cover may be configured to be slidable. The one or both of the slidable downstream cover and the upstream cover may be easier to operate than covers being pivotable about a hinge.

In the aerosol-generating device one or both of the upstream cover and the downstream cover may be configured to be manually opened by a user. The cover moving element may be activated upon opening of the upstream cover or upon opening of the downstream cover.

Thus, by opening either the downstream cover or the upstream cover, the cover moving element may easily be activated by a user.

The cover moving element of the aerosol-generating device may comprise a mechanical linkage between the upstream cover and the downstream cover.

This may provide an easy connection between the upstream cover and the downstream cover. This also may provide a mechanically coupling between both the upstream cover and the downstream cover. The mechanical linkage may facilitate that one cover is automatically opened by the cover moving element upon opening the other cover. In particular, a mechanical linkage may allow to automatically open the upstream cover when opening the downstream cover and automatically open the downstream cover when opening the upstream cover.

The mechanical linkage may comprise a slider being connected to both the upstream cover and the downstream cover.

Such a slider may ensure that when a user opens one cover that the other cover may be automatically opened. In particular, manually opening the upstream cover by a user may result in automatic opening of the downstream cover and vice versa.

The slider may be slidably mounted in the device. The slider may be configured for simultaneously moving the upstream cover and the downstream cover. The aerosol-generating device may comprise a central longitudinal axis and traverse central axis being perpendicular to the central longitudinal axis. The slider may be configured to be moved along the traverse central axis of the aerosol-generating device. The slider may be mounted within the aerosol-generating device on rails. The rails may be configured to allow the slider to move between a first position, where the upstream cover covers the upstream opening and wherein the downstream cover covers the downstream opening and a second position, where the upstream opening and the downstream opening are open and accessible. In the second position of the slider the upstream cover may be retracted from the upstream opening and the downstream cover may be retracted from the downstream opening.

The upstream cover may be slidably mounted in the aerosol-generating device on upstream rails. The upstream cover may comprise upstream protrusions with which the upstream cover is slidably mounted in the upstream rails. The downstream cover may be slidably mounted in the aerosol-generating device on downstream rails. The downstream cover may comprise downstream protrusions with which the downstream cover is slidably mounted in the downstream rails. The slider may directly connect both the upstream cover and the downstream cover. The slider may slidably be mounted within the aerosol-generating device. The slider may be configured to be slidable within the aerosol-generating device along a central transverse axis of the aerosol-generating device, the central transverse axis being perpendicular to a central longitudinal axis of the aerosol-generating device.

Such a configuration may easy to construct in order to provide a mechanical linkage between both the upstream cover and the downstream cover.

The slider may be formed as a plate. The plate may extend along the central longitudinal axis of the aerosol-generating device. The plate additionally also may extend along the central transverse axis of the aerosol-generating device.

A plate may only occupy a limited space within the aerosol-generating device.

The slider may be housed within a hollow space located within the aerosol-generating device. The hollow space may allow the slider to be moved between the first position, where both the upstream cover covers the upstream opening and the downstream cover covers the downstream opening and between the second position, where both covers are retracted from their respective openings.

The mechanical linkage of the aerosol-generating device may comprise a shaft rotatably mounted within the aerosol-generating device, wherein the shaft is rotatably connected to both the upstream cover and the downstream cover.

Such a shaft may allow a mechanical linkage between both the upstream cover and the downstream cover without the need to provide a large hollow space within the aerosol-generating device for mounting the shaft.

The shaft may comprise gear wheels and the upstream cover and the downstream cover may be rotatable connected to the gear wheels of the shaft via gear racks.

The gear racks and the gear wheels may provide a particular simple rotatable connection between the upstream cover and the downstream cover on the one hand and the rotatable shaft on the other hand.

The aerosol-generating device may comprise a drive mechanism configured for moving the upstream cover. The drive mechanism may comprise an electrical motor. The aerosol-generating device may comprise a shaft connected to the electrical motor, the shaft being configured for moving the upstream cover.

Such a drive mechanism may ensure that either the upstream cover or the downstream cover can automatically be opened by the drive mechanism.

The aerosol-generating device may comprise control circuitry for controlling the drive mechanism.

A user may input instructions for the control circuitry via a display. The control circuitry may be configured to be activated upon manually opening of either the downstream cover or the upstream cover by a user.

The downstream cover of the aerosol-generating device may comprise electrical cover connections for electrically connecting to the control circuitry. The electrical cover connections may indicate a position of the downstream cover relative to the downstream opening. In particular, the electrical cover connections may be connected to the control circuitry if the downstream cover covers the downstream opening. Upon manually opening the downstream cover, the electrical cover connections are moved away from the control circuitry, thereby disconnecting the electrical cover connections from the control circuitry. Such a position may indicate to the control circuitry that the downstream cover has been opened.

The aerosol-generating device may comprise a detector for detecting the presence of an article in the cavity. The detector may be configured for controlling the cover moving element. The detector may activate the cover moving element when an article is detected in the cavity.

Such a detector may ensure that either the downstream cover or the upstream cover is not automatically opened by the cover moving element, if an article is not detected in the cavity. Such a detector may ensure that one of the downstream cover or the upstream cover is not opened, if the other cover is accidentally be opened.

The detector may comprise a toggle switch, which is located at least partly in the cavity. The toggle switch may be configured to be triggered upon insertion of the article into the cavity. The toggle switch may comprise electrical switch connections for electrically contacting the control circuitry. The electrical switch connections may electrically contact the control circuitry if the article received in the cavity triggers the toggle switch.

When the downstream cover is in a closed position, the upstream cover may cover the at least one upstream opening. This may ensure that both, the upstream cover and the downstream cover are closed, so that no debris deposited in the cavity can accidentally leave the aerosol-generating device. Likewise, no contaminations from the outside may enter the device if both the upstream cover and the downstream cover are closed.

The article to be received by the cavity of the aerosol-generating device may be one or both of an aerosol-generating article and a cleaning article.

The cleaning article may comprise a cleaning head. The cleaning article may for example comprise a brush. The cleaning article may comprise a central longitudinal stick from which bristles protrude. The longitudinal stick may comprise one or more of metal, plastics or wood. The bristles may be configured for cleaning the cavity of the aerosol-generating device. The cavity may comprise sidewalls and the bristles may be configured for cleaning the sidewalls of the cavity. The cleaning head of the cleaning article may comprise absorbent material, configured for absorbing any residues located in the cavity. The cleaning head may comprise cotton as an absorbent material.

The at least one upstream opening may form an air inlet of the aerosol-generating device. The air inlet may allow ambient air to enter the aerosol-generating device, in particular its cavity. Preferably, a plurality of air inlets may be present in the aerosol-generating device and at least a part or all of the air inlets may be covered by the upstream cover of the aerosol-generating device when it is closed.

The at least one upstream opening also may be configured for receiving the article. The at least one upstream opening may be one single upstream opening. The upstream opening may have a circumference and a diameter similar or equal to the downstream opening. In particular, the upstream opening may have a circumference and a diameter differing from the circumference and the diameter of the downstream opening by not more than 20 percent, preferably 10 percent, most preferably 5 percent. The article being received in the upstream opening may be a cleaning article as mentioned above. Thus, it may be possible to clean the cavity of the aerosol-generating device by inserting a cleaning article into the cavity from the upstream opening towards the downstream opening. Subsequently, the cleaning article may be removed from the cavity by pulling the cleaning article through the upstream opening. Alternatively, or additionally, the cavity of the aerosol-generating article may be cleaned by inserting the cleaning article through the downstream opening into the cavity and guiding the cleaning article through the upstream opening of the cavity. This may greatly ease the cleaning procedure.

As used herein, the term 'aerosol-generating article' refers to an article comprising an aerosol-forming substrate that is capable of releasing volatile compounds that can form an aerosol. The aerosol-generating article may comprise a substrate portion comprising the aerosol-forming substrate. For example, an aerosol-generating article may be a smoking article that generates an aerosol that is directly inhalable into a user's lungs through the user's mouth. An aerosol-generating article may be disposable.

As used herein, the term 'aerosol-forming substrate' relates to a substrate capable of releasing one or more volatile compounds that can form an aerosol. Such volatile compounds may be released by heating the aerosol-forming substrate. An aerosol-forming substrate may conveniently be part of an aerosol-generating article or smoking article.

The aerosol-forming substrate may be a solid aerosol-forming substrate. The aerosol-forming substrate may comprise both solid and liquid components. The aerosol-forming substrate may comprise a tobacco-containing material containing volatile tobacco flavour compounds which are released from the substrate upon heating. The aerosol-forming substrate may comprise a non-tobacco material. The aerosol-forming substrate may comprise an aerosol former that facilitates the formation of a dense and stable aerosol. Examples of suitable aerosol formers are glycerine and propylene glycol.

The aerosol-forming substrate of the substrate portion may comprise a plug of formed aerosol-forming substrate. The plug may be a pressed or molded substrate portion containing the aerosol-forming substrate or it may be a pre-packaged substrate portion including a wrapper, such as paper being wrapped around the aerosol-forming substrate. The aerosol-forming substrate may also comprise a gel. The aerosol-forming substrate may comprise a non-volatile carrier material together which one or both of volatile aerosol-formers and one or more active agents which can form part of the aerosol. Examples of non-volatile carrier material may be paper or cotton. The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may comprise homogenized tobacco. The aerosol-forming substrate may alternatively comprise a non-tobacco-containing material. The aerosol-forming substrate may comprise homogenised plant-based material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The aerosol-generating article may comprise a hollow tubular article portion. The hollow tubular article portion may have a tubular empty core structure. The hollow tubular article portion may be for example a hollow acetate tube (HAT), a fine hollow acetate tube (FHAT) or a plug of tow wrapped around a central cardboard tube, or a tube formed of cardboard all of which structures being known from manufacture of filter elements. The hollow tubular article portion may be located downstream of the substrate portion of the aerosol-generating article. The hollow tubular article portion may serve to cool down the aerosol generated from the substrate portion of the aerosol-generating article.

If desired or required, for example to achieve a sufficiently high resistance to draw of the aerosol-generating article, an additional filter portion may be included in the aerosol-generating article. Preferably such additional filter portion may be included downstream of the substrate portion. If the hollow tubular article portion is also included in the aerosol-generating article, the filter portion may be located downstream of the hollow tubular article portion. Preferably, such additional filter portion comprises a filtration material such as, for example, cellulose acetate.

Additionally, a mouthpiece may be present at the downstream end of the aerosol-generating article or the downstream end of the aerosol-generating device.

The cavity of the aerosol-generating device may have an open end into which the aerosol-generating article is inserted. The open end may be a proximal end. The open end may be arranged downstream of the cavity. The cavity may have an elongate extension. The cavity may have a longitudinal central axis. A longitudinal direction may be the direction extending between the open and closed ends along the longitudinal central axis. The longitudinal central axis of the cavity may be parallel to the longitudinal axis of the aerosol-generating device.

The cavity may be configured as a heating chamber. The cavity may have a cylindrical shape. The cavity may have a hollow cylindrical shape. The cavity may have a shape corresponding to the shape of the aerosol-generating article to be received in the cavity. The cavity may have a circular cross-section. The cavity may have an elliptical or rectangular cross-section. The cavity may have an inner diameter corresponding to the outer diameter of the aerosol-generating article.

An airflow channel may run through the cavity. Ambient air may be drawn into the aerosol-generating device, into the cavity and towards the user through the airflow channel. Downstream of the cavity, a mouthpiece may be arranged or a user may directly draw on the aerosol-generating article. The airflow channel may extend through the mouthpiece.

As used herein with reference to the present invention, the term 'smoking' with reference to a device, article, system, substrate, or otherwise does not refer to conventional smoking in which an aerosol-forming substrate is fully or at least partially combusted. The aerosol-generating device of the present invention is arranged to heat the aerosol-forming substrate to a temperature below a combustion temperature of the aerosol-forming substrate, but at or above a temperature at which one or more volatile compounds of the aerosol-forming substrate are released to form an inhalable aerosol.

The aerosol-generating device may furthermore comprise a heating element. The heating element may serve to heat an aerosol-generating article received in the cavity in order to produce an aerosol. The heating element may comprise one or both of an inductive heating element and a resistive heating element. The inductive heating element may comprise an inductor coil disposed around at least a portion of the cavity and connected to a power supply. The power supply may be configured to provide an alternating electric current to the inductor coil, such that in use, the inductor coil may generate an alternating magnetic field to heat a susceptor by creating eddy currents. The susceptor may be part of one or both of the aerosol-generating device and the aerosol-generating article received in the cavity of the aerosol-generating device. Preferably, the susceptor may be part of the aerosol-generating device or the aerosol-generating article.

As described herein, induction heating may be utilized. For induction heating, the induction coil and the susceptor are provided. In general, a susceptor is a material that is capable of generating heat, when penetrated by an alternating magnetic field. When located in an alternating magnetic field. If the susceptor is conductive, then typically eddy currents are induced by the alternating magnetic field. If the susceptor is magnetic, then typically another effect that contributes to the heating is commonly referred to hysteresis losses. Hysteresis losses occur mainly due to the movement of the magnetic domain blocks within the susceptor, because the magnetic orientation of these will align with the magnetic induction field, which alternates. Another effect contributing to the hysteresis loss is when the magnetic domains will grow or shrink within the susceptor. Commonly all these changes in the susceptor that happen on a nano-scale or below are referred to as "hysteresis losses", because they produce heat in the susceptor. Hence, if the susceptor is both magnetic and electrically conductive, both hysteresis losses and the generation of eddy currents will contribute to the heating of the susceptor. If the susceptor is magnetic, but not conductive, then hysteresis losses will be the only means by which the susceptor will heat, when penetrated by an alternating magnetic field. According to the invention, the susceptor may be electrically conductive or magnetic or both electrically conductive and magnetic. An alternating magnetic field generated by one or several induction coils heat the susceptor, which then transfers the heat to the aerosol-forming substrate, such that an aerosol is formed. The heat transfer may be mainly by conduction of heat. Such a transfer of heat is best, if the susceptor is in close thermal contact with the aerosol-forming substrate.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element, particularly to the induction coil. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The aerosol-generating device may comprise a power supply, typically a battery, within a main body of the aerosol-generating device. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

In one preferred embodiment, the invention provides an aerosol-generating device wherein the cover moving element is configured for opening of the upstream cover upon one or both of: opening of the downstream cover and insertion of the article into the cavity. Such a preferred embodiment of the aerosol-generating device of the invention may allow the automatic opening of the upstream cover when a user performs one or both of the following actions: opening of the downstream cover or insertion of the article into the cavity. The at least one upstream opening may be at least one air inlet. When both the downstream cover and the upstream cover cover their respective openings, any debris deposited in the cavity cannot accidentally exit the aerosol-generating device. The upstream cover is only opened by the cover moving element when a user opens the downstream cover for either operating the aerosol-generating device by inserting an aerosol-generating article into the cavity or by cleaning the device by inserting a cleaning article.

In another preferred embodiment, the invention provides an aerosol-generating device wherein the cover moving element is configured for opening the upstream cover upon opening of the downstream cover. In this case the cover moving element may comprise a mechanical linkage between the upstream cover and the downstream cover as described herein. It also may be possible that the cover moving element comprises a drive mechanism comprising a control circuitry for controlling the drive mechanism. The control circuitry may sense the opening of the downstream cover for example via the electrical cover connections for electrically connecting to the control circuitry as described herein.

In another preferred embodiment of the invention the cover moving element of the aerosol-generating device is configured for opening the upstream cover upon both opening of the downstream cover and insertion of the article into the cavity. In this case, the cover moving element requires the feedback of both the opening of the downstream cover and the insertion of the article into the cavity in order to automatically open the upstream cover. The cover moving element preferably may comprise a drive mechanism and control circuitry for controlling the drive mechanism. The control circuitry may be configured to receive feedback about both the opening of the downstream cover and about the insertion of an article into the cavity. This may require a detector element which may be configured for controlling the cover moving element, wherein the detector element is configured for both sensing the opening of the downstream cover and for detecting the presence of an article in the cavity. In this case electrical cover connections may be present on the downstream cover which are configured for sensing the opening of the downstream cover. Additionally, a detector for detecting the presence of the article in the cavity may be present, preferably within the cavity of the aerosol-generating device. Such a detector may be the toggle switch already described herein.

In another embodiment of the invention the cover moving element of the aerosol-generating device may be configured for opening the downstream cover upon one or both of: opening of the upstream cover or insertion of an article into the cavity. In this case, one or both of the opening of the upstream cover and the insertion of an article into the cavity may trigger the opening of the downstream cover by the cover moving element of the aerosol-generating device. This may be advantageous if a cleaning article is inserted into the cavity for cleaning the cavity of the aerosol-generating device. When both, the upstream cover and the downstream cover are opened, the cavity of the aerosol-generating device may be fully accessible for cleaning. Preferably, the cover moving element of the aerosol-generating device may be configured for opening the downstream cover upon opening of the upstream cover. In this case, a user may manually open the upstream cover, thereby automatically opening the downstream cover. In this case, the cover moving element preferably may comprise a mechanical linkage between the upstream cover and the downstream cover. Such a mechanical linkage may enable a user to open the upstream cover and at the same time automatically also open the downstream cover due to the mechanical linkage between both covers.

In another embodiment of the invention, the cover moving element of the aerosol-generating device may be configured for closing both the upstream cover and the downstream cover upon removal of an article from the cavity. Such an cover moving element may be advantageous, if after cleaning of the cavity of the aerosol generating device the cleaning article is removed from the cavity and both the upstream cover and the downstream cover are automatically closed by the cover moving element of the aerosol-generating device. This may avoid that a user can put accidentally fingers into the cavity after the article has been removed from the cavity. In this case the cover moving element preferably may be a drive mechanism and the aerosol-generating device furthermore may comprise control circuitry for controlling the drive mechanism. A sensor configured for detecting the presence of the article in the cavity may be present, which is configured for controlling the cover moving element, preferably via the control circuitry.

The invention also may provide an aerosol-generating system comprising the aerosol-generating device as described herein and one or both of an aerosol-generating article comprising the aerosol-forming substrate and the cleaning article.

The invention also provides a method for operating the aerosol-generating system, the method comprising:

- moving the downstream cover from the downstream opening,
- inserting an article into the cavity wherein the cover moving element moves the upstream cover from the at least one upstream opening upon one or both of:

moving of the downstream cover or insertion of the article into the cavity.

This method of operating may allow an easy operating of the aerosol-generating system providing an air flow path through the cavity of the device from the upstream opening to the downstream opening. Both covers, the downstream cover and the upstream cover may be opened, wherein a user only manually has to open the downstream cover and, if necessary, insert an article into the cavity in order to activate an automatic opening of the upstream cover of the aerosol-generating device. The article may be an aerosol-generating article. In this case the method of operating the aerosol-generating system may be a method of using the aerosol-generating system for generating an aerosol to be inhaled by a user. The aerosol-generating article may rod-shaped. The cavity may have a tubular shape. The at least one upstream opening may be an air inlet for providing ambient air to the cavity of the aerosol-generating device. The air inlet may have a size smaller than the diameter of the aerosol-generating article. The air inlet may be provided in an upstream end base of the cavity. The upstream end base of the cavity may be a cover, covering the upstream end of the cavity. In this case, the aerosol-generating article may be reliably held within the cavity by the base of the cavity. Alternatively, the at least one upstream opening may have a size comparably or identical to the diameter of the aerosol-generating article. The aerosol-generating article may have a diameter being slightly larger than the diameter of the tubular-shaped cavity. This may enable the aerosol-generating article to be reliably received in the cavity of the aerosol generating device without the risk of slipping through the open upstream opening of the cavity. In particular, an aerosol-generating article having a slightly larger diameter than the diameter of the sidewalls of the tubular cavity may be reliably clamped in the cavity without the risk of slipping through the upstream opening. Alternatively, the article inserted into the cavity may be a cleaning article. In this case, the method of operating the aerosol-generating system may be a method of cleaning the aerosol-generating system using the cleaning article.

The invention also may provide a method for operating the aerosol-generating system described herein, the method comprising:

moving the upstream cover from the upstream opening, inserting an article into the cavity from the upstream opening, wherein the cover moving element moves the downstream cover from the downstream opening upon one or both of moving of the upstream cover or insertion of the article into the cavity.

This method of operating the aerosol-generating system may enable an easy cleaning of the cavity of the aerosol-generating device due to the automatic opening of the downstream cover when a cleaning article is used. Since both, the upstream cover and the downstream cover may be open, the cleaning article can easily be inserted into the cavity for cleaning.

This method of operating the aerosol-generating system may provide a method of using the aerosol-generating system, if an aerosol-generating article is used. The article may be inserted into the cavity through the upstream opening. Either the insertion of the aerosol-generating article into the cavity or the opening of the upstream cover or both the insertion of the aerosol-generating article and the opening of the upstream cover may lead to the cover moving element moving the downstream cover from the downstream opening.

The invention also may provide a method for operating the aerosol-generating system, the method comprising:

removing an article from the cavity, wherein the cover moving element moves the upstream cover over the at least one upstream opening and wherein the cover moving element moves the downstream cover over the downstream opening upon removal of the article from the cavity.

This method may provide an easy automatic closing of both the upstream cover and the downstream cover once the article, preferably a cleaning article has been removed from the cavity of the aerosol-generating device. This may prevent a user from accidentally putting fingers into the cavity after the cleaning article has been removed from the cavity.

Below, there is provided a non-exhaustive list of non-limiting examples. Any one or more of the features of these examples may be combined with any one or more features of another example, embodiment, or aspect described herein.

Example A: An aerosol-generating device comprising:

a cavity for receiving an article, the cavity comprising a downstream opening for receiving the article and at least one upstream opening, a movable downstream cover for covering the downstream opening, a movable upstream cover for covering the at least one upstream opening, and a cover moving element configured for one or more of:

opening of the upstream cover upon one or both of: opening of the downstream cover or insertion of the article into the cavity, and closing of the upstream cover upon one or both of: closing of the downstream cover or removal of the article from the cavity opening of the downstream cover upon one or both of: opening of the upstream cover or insertion of the article into the cavity, and closing of the downstream cover upon one or both of: closing of the upstream cover or removal of the article from the cavity.

Example B: The aerosol-generating device of the preceding Example A, wherein the aerosol-generating device comprises an upstream end face comprising the at least one upstream opening and wherein the upstream cover is configured to be slidable over the upstream end face.

Example C: The aerosol-generating device of any of the preceding examples, wherein the aerosol-generating device comprises a downstream end face comprising the downstream opening and wherein the downstream cover is configured to be slidable over the downstream end face.

Example D: The aerosol-generating device of any of the preceding examples, wherein one or both of the upstream cover and the downstream cover are configured to be manually opened by a user, preferably wherein the cover moving element is activated upon opening of the upstream cover or upon opening of the downstream cover.

Example E: The aerosol-generating device of any of the preceding examples, wherein the cover moving element comprises a mechanical linkage between the upstream cover and the downstream cover.

Example F: The aerosol-generating device of the preceding Example E, wherein the mechanical linkage comprises a slider being connected to both the upstream cover and the downstream cover, wherein the slider is slidably mounted in the device, preferably wherein the slider is configured for simultaneously moving the upstream cover and the downstream cover.

Example G: The aerosol-generating device of Example E, wherein the mechanical linkage comprises a shaft rotatably mounted to the aerosol-generating device, wherein the shaft is rotatably connected to both the upstream cover and the downstream cover, preferably wherein the shaft comprises gear wheels and the upstream cover and the downstream cover are rotatable connected to the gear wheels of the shaft via gear racks.

Example H: The aerosol-generating device of any of the Examples A or B, comprising a drive mechanism configured for moving the upstream cover, preferably wherein the drive mechanism comprises an electrical motor, more preferably wherein the aerosol-generating device comprises a shaft connected to the electrical motor, the shaft being configured for moving the upstream cover.

Example I: The aerosol-generating device of the preceding Example H, further comprising control circuitry for controlling the drive mechanism, more preferably wherein the downstream cover comprises electrical cover connections for electrically connecting to the control circuitry.

Example J: The aerosol-generating device of any of the Examples A, B or H, comprising a detector for detecting the presence of an article in the cavity, wherein the detector is configured for controlling the cover moving element.

Example K: The aerosol-generating device of the preceding Example J, wherein the detector comprises a toggle switch, which is located at least partly in the cavity, preferably wherein the toggle switch is configured to be triggered upon insertion of said article into the cavity.

Example L: The aerosol-generating device of any of the preceding examples, wherein the cover moving element is configured for automatically opening or closing the upstream opening.

Example M: The aerosol-generating device of any of the preceding examples, wherein the at least one upstream opening forms an air inlet, preferably wherein a plurality of air inlets are present in the aerosol-generating device.

Example N: The aerosol-generating device of any of the preceding examples, wherein the upstream cover covers the at least one upstream opening when the downstream cover is in a closed position.

Example O: An aerosol-generating system, comprising an aerosol-generating device of any of the preceding claims and one or both of:

an aerosol-generating article comprising aerosol-forming substrate; and a cleaning article.

Example P: Method for operating the aerosol-generating system of the preceding Example O, the method comprising:

moving the downstream cover from the downstream opening, inserting the article into the cavity, wherein the cover moving element moves the upstream cover from the at least one upstream opening upon one or both of:

moving of the downstream cover or insertion of the article into the cavity.

Example Q: Method for operating of the preceding Example O, comprising:

removing the article from the cavity, moving the downstream cover over the downstream opening, wherein the cover moving element moves the upstream cover over the at least one upstream opening upon one or both of:

moving of the downstream cover; and removal of the article from the cavity.

Example R: Method for operating the aerosol-generating system of Example O, the method comprising:

removing the article from the cavity, wherein the cover moving element moves the upstream cover over the at least one upstream opening and wherein the cover moving element moves the downstream cover over the downstream opening upon removal of the article from the cavity.

Features described in relation to one embodiment may equally be applied to other embodiments of the invention.

The invention will be further described, by way of example only, with reference to the accompanying drawings in which.

In the following the same elements are marked with the same reference numerals throughout all the figures.

Figure 1A:
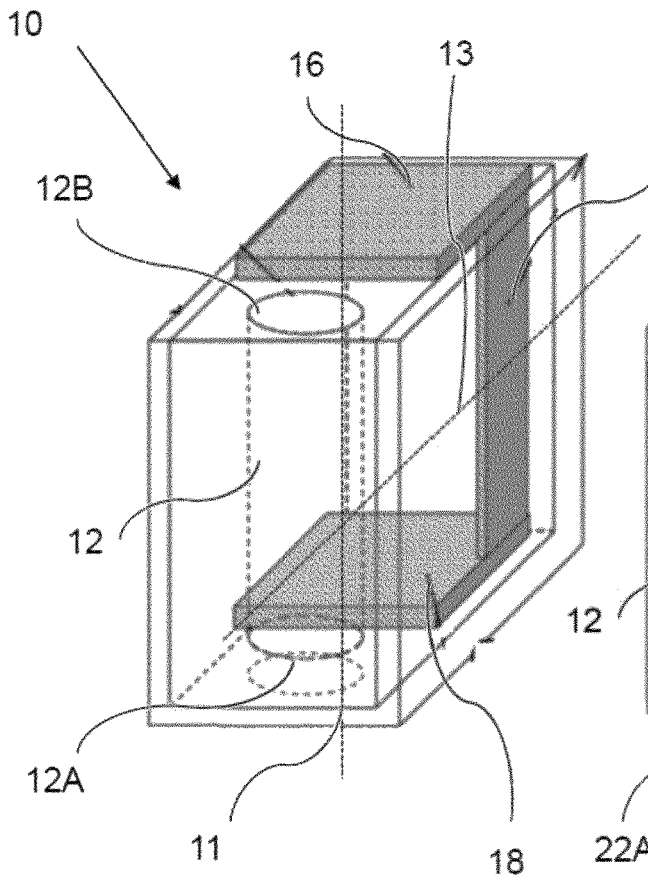
FIGS. 1A and 1B show a simplified perspective view of one embodiment of the aerosol-generating device with a slider when it is opened (FIG. 1A) and in the closed state (FIG. 1B)
Figure 1B:
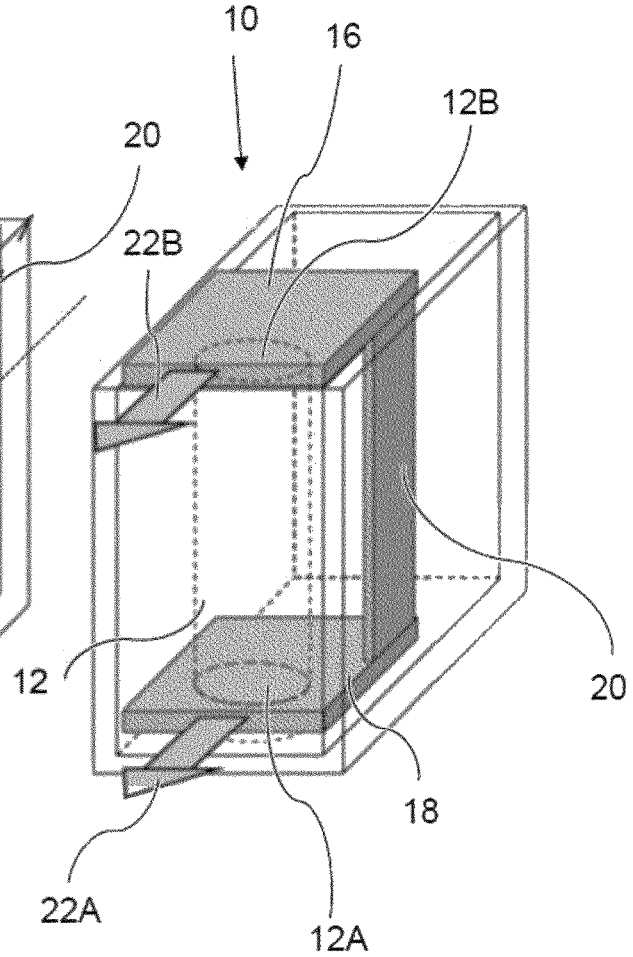

FIG. 1A depicts an aerosol-generating device 10 including a cavity 12 for receiving an article. The cavity 12 comprises an upstream opening 12A and a downstream opening 12B which are both accessible. The cavity 12 can receive an aerosol-generating article, which then can be heated via a heating element (heating element not shown in the FIGS. 1A and 1B) in order to produce an aerosol to be inhaled by a user. The cavity 12 also might be cleaned by receiving a cleaning article, such as a brush. A movable upstream cover 18 and a movable downstream cover 16 are included in the aerosol-generating device, which are both mechanically connected by a slider 20 and which are retracted from their respective openings in FIG. 1A. The aerosol-generating device thus includes a very simple mechanical cover moving element in the form of a slider. If a user manually opens the movable downstream cover then automatically the movable upstream cover is opened, due to the slider. Similarly, if a user manually opens the movable upstream cover, the downstream cover automatically is opened. FIG. 1B depicts the aerosol-generating device of FIG. 1A in the closed state. By moving either the downstream cover in the direction indicated by the arrow 22B or the upstream cover in the direction indicated by the arrow 22A, both covers are automatically moved over their respective openings, thereby closing both the upstream opening and the downstream opening of the device.

Figure 2:
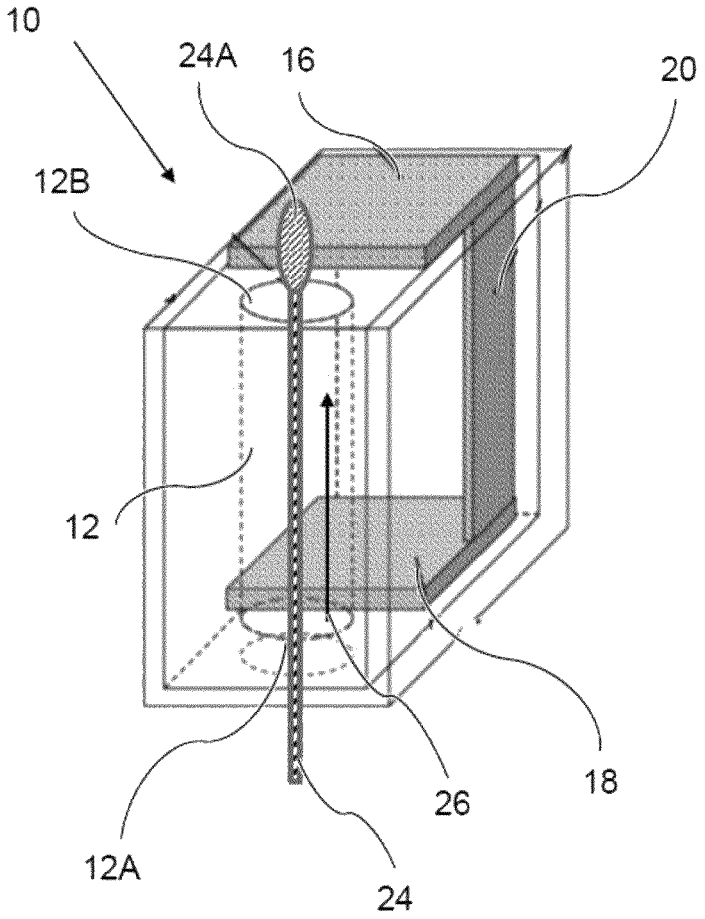
FIG. 2 shows the aerosol-generating device with an opened downstream cover and an opened upstream cover receiving a cleaning article.

FIG. 2 shows the aerosol-generating device of FIG. 1A, wherein a cleaning article 24, for example a brush including a cleaning head 24A is guided through the cavity 12 in the direction of the arrow 26. When both the upstream cover 18 and the downstream cover 16 are retracted from their respective openings 12A and 12B, the upstream opening 12A and the downstream opening 12B of the cavity 12 are easily accessible for cleaning.

Figure 3:
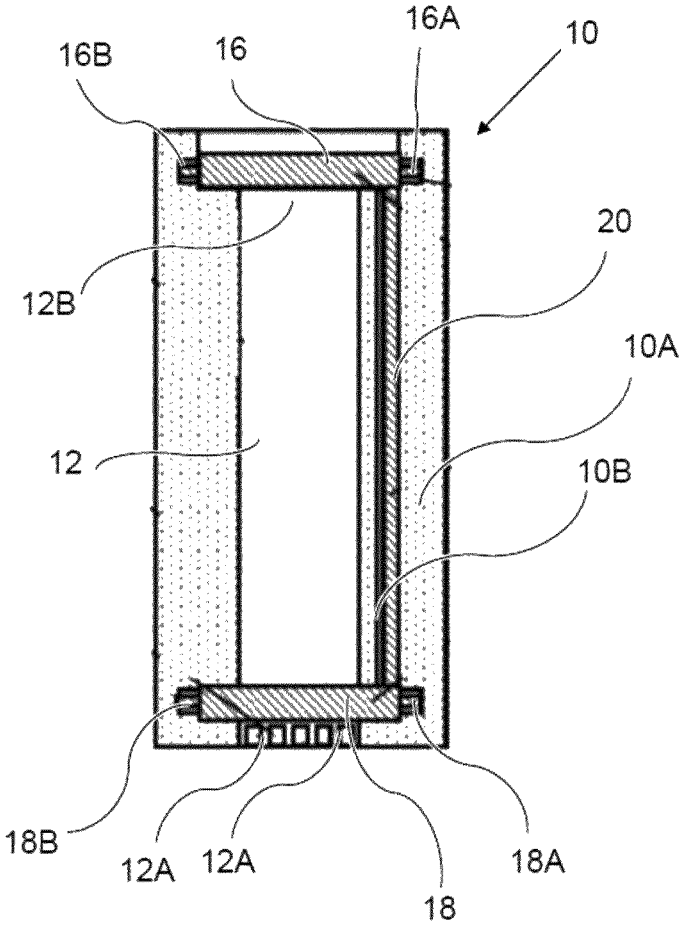
FIG. 3 depicts a cross-sectional view of an aerosol-generating device with a slider as a cover moving element detailing the interconnections between the slider and the aerosol-generating device.

FIG. 3 shows the details of the connection between the housing 10A of the aerosol-generating device 10 and the slider 20 in another embodiment of the aerosol-generating device of the invention. The slider is slidably mounted within the housing 10A of the aerosol-generating device. In particular, the upstream cover 18 includes protrusions 18A and 18B which are mounted in the housing 10A via rails. Likewise, the downstream cover 16 includes protrusions 16A and 16B which are also mounted via rails within the housing 10A of the aerosol-generating device. The slider is mounted within a hollow space 10B of the housing 10A which allows the slider to be moved along a traverse central axis 13 of the device, which is perpendicular to a central longitudinal axis 11 of the aerosol-generating device as shown in FIG. 1A. The protrusions in the upstream cover and in the downstream cover allow the slider to be moved within the housing 10A of the device in order to simultaneously open or close the downstream cover and the upstream cover.

Figure 4:
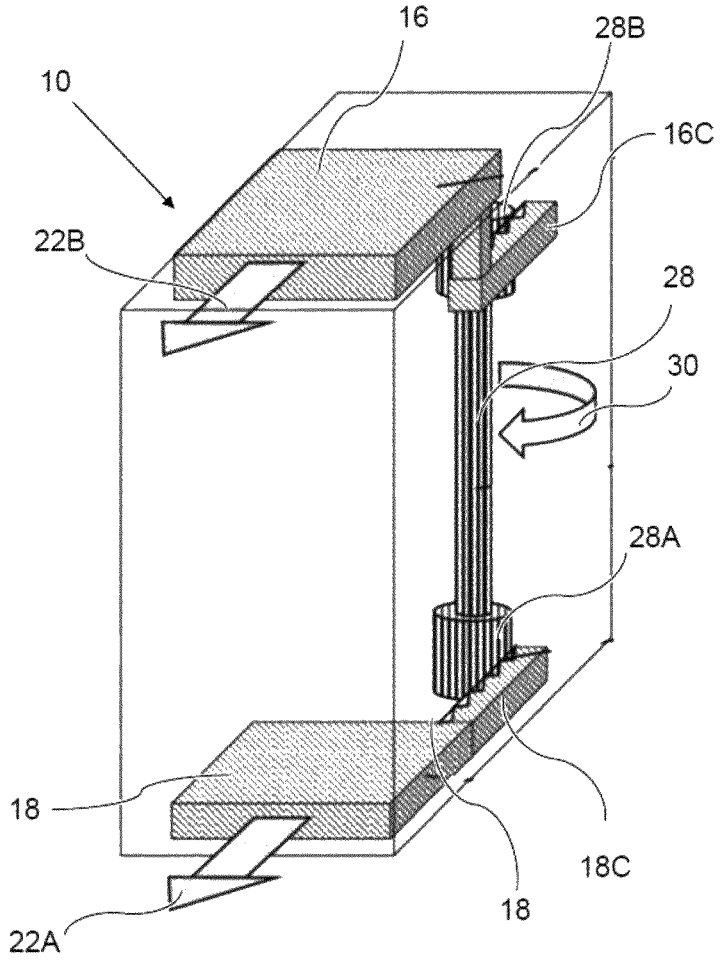
FIG. 4 depicts a simplified perspective view of another embodiment of an aerosol-generating device with a rotatable shaft.

FIG. 4 shows a perspective view of another embodiment of an aerosol-generating device, wherein the cover moving element comprises a rotatable shaft 28. The rotatable shaft 28 is rotatably mounted within the aerosol-generating device 10 and is mechanically connected to the upstream cover 18 and to the downstream cover 16 via two gear wheels, an upstream gear wheel 28A and a downstream gear wheel 28B. Both gear wheels engage with gear racks connected to the respective movable upstream and downstream covers. In particular, the upstream gear wheel 28A engages with the upstream gear rack 18C of the movable upstream cover 18. Likewise, the downstream gear wheel 28B engages with the downstream gear rack 16C of the movable downstream cover 16. By manually opening the downstream cover 16, the upstream cover 18 is automatically opening due to the rotation of the rotatable shaft 28 indicated by the arrow 30. The arrows 22A and 22B depict the direction of the movement of the movable upstream cover 18 and the movable downstream cover 16. This allows for an easy mechanical linkage between the upstream cover and the downstream cover without the need for providing a large hollow space within the housing of the aerosol-generating device. The cover moving element comprising the rotatable shaft can also be used to close both covers simultaneously.

Figure 5A:
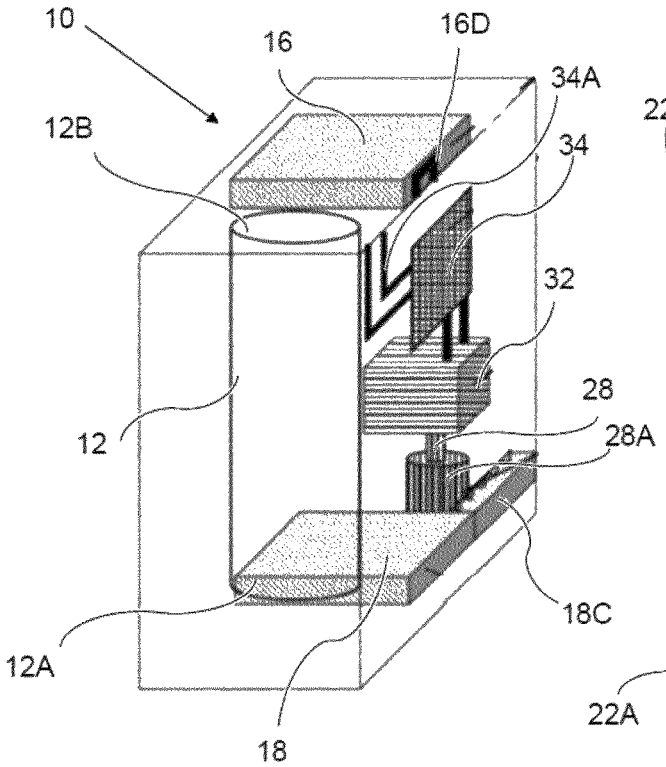
FIGS. 5A and 5B depict schematic perspective views of another embodiment of an aerosol-generating device with a drive mechanism in the opened and closed state.
Figure 5B:
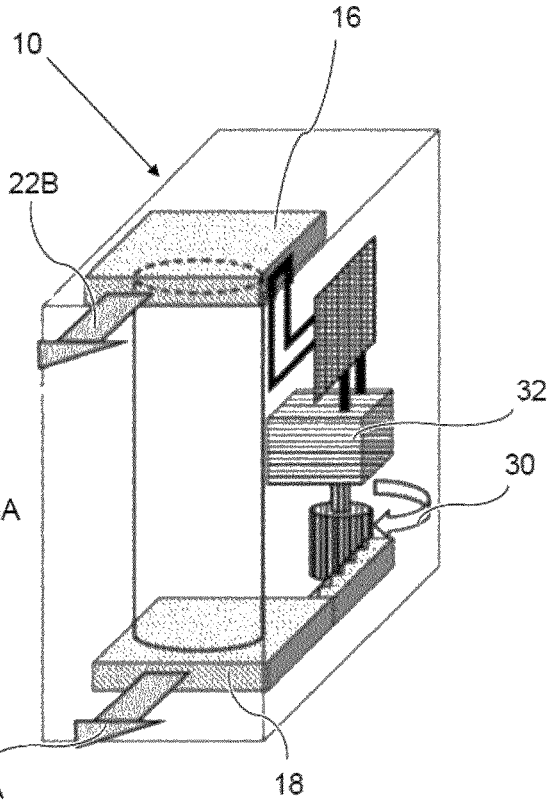

FIGS. 5A and 5B show schematic perspective views of another embodiment of an aerosol-generating device, wherein the cover moving element comprises an electrical motor 32 as one example of a drive mechanism. FIG. 5A shows the device in the open state, wherein both the upstream opening 12A and the downstream opening 12B of the cavity 12 are accessible. The downstream cover 16 has been manually opened by a user, which results in breaking the electrical connection between the electrical cover connections 16D included in the movable downstream cover 16 and the electrical connections 34A. These electrical connections 34A establish an electrical connection between the electrical cover connections 16D and a control circuitry 34. The control circuitry 34 controls the electric motor 32 which is configured to open the upstream cover 16 by rotating a rotatable shaft 28, which is mechanically connected to the movable upstream cover 18 via an upstream gear wheel 28A. Gear wheel 28A engages with the gear rack 18C of the movable upstream cover 18, allowing to move the movable upstream cover 18 away from the upstream opening by rotating the shaft 28. Breaking the electrical connection between the electrical cover connections 16D and the electrical connections 34A triggers an opening of the upstream cover 18 by the electric motor 32.

Likewise, if a user manually closes the movable downstream cover 16 as indicated by the arrow 22B, the electrical connection between the electrical cover connections 16D of the movable downstream cover and the electrical connections 34A is re-established. This triggers the electrical motor 32 via the control circuitry 34 to simultaneously close the upstream cover 18, as indicated by the arrow 22A. Thus, the cover moving element of the aerosol-generating device 10 enables an easy handling of the aerosol-generating device without the necessity for a user to manually operate both, the downstream cover and the upstream cover of the device. A skilled person will appreciate, that it is also possible to indicate the position of the movable downstream cover 16 by establishing an electrical connection between the electrical cover connections 16D and the electrical connections 34A, when the movable downstream cover is retracted from the downstream opening. Consequently, the electrical connection between the electrical cover connections 16D and the electrical connections 34A would then be broken upon closing the movable downstream cover over the downstream opening.

Figure 6:
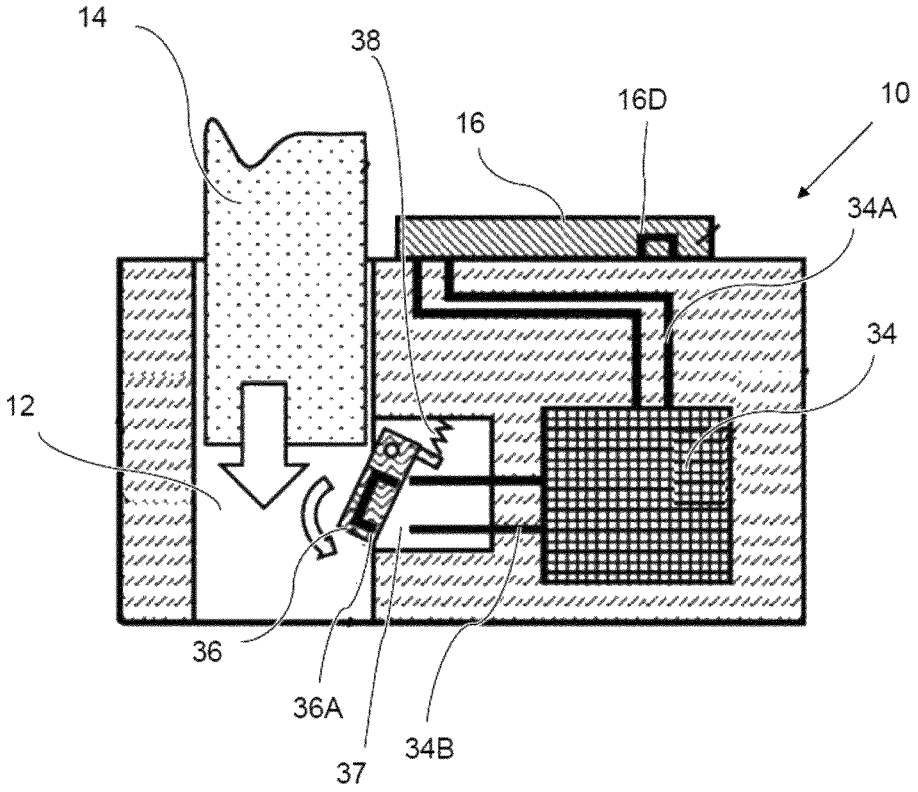
FIG. 6 shows a cross-sectional view of a further embodiment of an aerosol-generating device with a toggle switch for detecting the presence of an article in the cavity of the aerosol-generating device.

FIG. 6 depicts a schematic cross-sectional view of another aerosol-generating device. This aerosol-generating device includes a detector for detecting the presence of an article in the cavity 12 of the aerosol-generating device 10. The detector is a toggle switch 36, which includes electrical detector connections 36A. The toggle switch 36 is rotatably mounted to the aerosol-generating device 10 via a biasing member, in particular a spring 38. A user manually opens the downstream cover 16, thereby breaking the electrical connection between the electrical connections 34A and the electrical cover connections 16D. When inserting an aerosol-generating article 14 or a cleaning article into the cavity 12 of the device, the toggle switch 36 is pushed by the article via the spring 38 into the recess 37 of the aerosol-generating device. This establishes an electrical connection between the electrical detector connections 36A and the electrical connections 34B. The breaking of the electrical connections between the electrical connections 34A and the electrical cover connections 16D and the establishing of an electrical connection between the electrical detector connections 36A and the electrical connections 34B triggers an electrical motor (motor not shown in FIG. 6) controlled by the control circuitry 34 to open the upstream cover (upstream cover not shown in FIG. 6).

Figure 7:
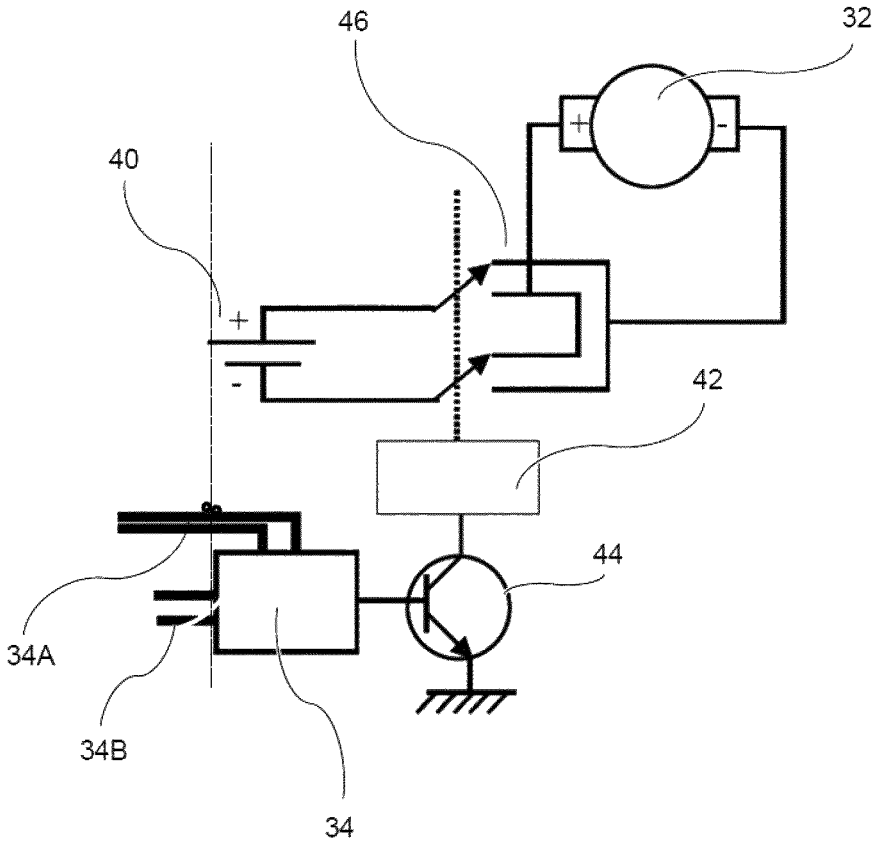
FIG. 7 depicts one way of using an electrical motor to open and close the upstream cover upon mechanically opening and closing the downstream cover.

FIG. 7 shows a schematic circuit diagram of an electric circuit for an electric motor 32 connected to a dual post single throw relay 42. The electrical motor could be included in the aerosol-generating device with the toggle switch shown in FIG. 6. The electric motor 32 is powered by a battery 40. A micro control unit 34 as one embodiment of a control circuitry is present which activates the dual post single throw relay 42 depending on the signals coming from the electrical connections 34A for establishing electrical connections with the electrical cover connections of the movable downstream cover and the electrical connections 34B, which can provide connections to the electrical detector connections of the toggle switch. If on the one hand an electrical connection between the electrical detector connections 36A and the electrical connections 34B is absent (indicating that no article is inserted in the cavity) and at the same time an electrical connection between the electrical connections 34A and the electrical cover connections 16D is present (indicating the manual closing of the downstream cover), then the control circuitry 34 via the dual post single throw relay would trigger the motor to close the upstream cover by rotating in a first direction. If on the other hand an electrical connection between the electrical detector connections 36A and the electrical connections 34B is detected (indicating that an article has been inserted in the cavity) and at the same time an electrical connection between the electrical connections 34A and the electrical cover connections 16D is not detected (indicating the manual opening of the downstream cover), then the control circuitry 34 via the dual post single throw relay would trigger the motor to open the upstream cover by rotating in a second direction being opposite to the first direction.

The invention claimed is:

1. An aerosol-generating device, comprising:

a cavity configured to receive an article, the cavity comprising a downstream opening for receiving the article and at least one upstream opening;

a movable downstream cover configured to cover the downstream opening;

a movable upstream cover configured to cover the at least one upstream opening;

a cover moving element configured for one or more of:

opening of the movable upstream cover upon one or both of opening of the movable downstream cover or insertion of the article into the cavity, closing of the movable upstream cover upon one or both of closing of the movable downstream cover or removal of the article from the cavity, opening of the movable downstream cover upon one or both of opening of the movable upstream cover or insertion of the article into the cavity, and closing of the movable downstream cover upon one or both of closing of the movable upstream cover or removal of the article from the cavity; and an upstream end face comprising the at least one upstream opening, wherein the movable upstream cover is further configured to be slidable over the upstream end face.

2. The aerosol-generating device according to claim 1, wherein the cover moving element comprises a mechanical linkage between the movable upstream cover and the movable downstream cover.

3. The aerosol-generating device according to claim 2, wherein the mechanical linkage comprises a slider being connected to both the movable upstream cover and the movable downstream cover, and wherein the slider is slidably mounted in the aerosol-generating device.

4. The aerosol-generating device according to claim 2, wherein the mechanical linkage comprises a slider being connected to both the movable upstream cover and the movable downstream cover, wherein the slider is slidably mounted in the device, and wherein the slider is configured for simultaneously moving the movable upstream cover and the movable downstream cover.

5. The aerosol-generating device according to claim 2, wherein the mechanical linkage comprises a shaft rotatably mounted to the aerosol-generating device, and wherein the shaft is rotatably connected to both the movable upstream cover and the movable downstream cover.

6. The aerosol-generating device according to claim 2, wherein the mechanical linkage comprises a shaft rotatably mounted to the aerosol-generating device, wherein the shaft is rotatably connected to both the movable upstream cover and the movable downstream cover, and wherein the shaft comprises gear wheels and the movable upstream cover and the movable downstream cover are rotatably connected to the gear wheels of the shaft via gear racks.

7. The aerosol-generating device according to claim 1, further comprising a drive mechanism configured for moving the movable upstream cover.

8. The aerosol-generating device according to claim 7, wherein the drive mechanism comprises an electrical motor, and wherein the aerosol-generating device further comprises a shaft connected to the electrical motor, the shaft being configured for moving the movable upstream cover.

9. The aerosol-generating device according to claim 7, further comprising control circuitry configured to control the drive mechanism.

10. The aerosol-generating device according to claim 9, wherein the movable downstream cover comprises electrical cover connections configured to electrically connect to the control circuitry.

11. The aerosol-generating device according to claim 1, further comprising a detector configured to detect a presence of the article in the cavity and to control the cover moving element.

12. The aerosol-generating device according to claim 11, wherein the detector comprises a toggle switch, which is located at least partly in the cavity.

13. The aerosol-generating device according to claim 12, wherein the toggle switch is configured to be triggered upon insertion of the article into the cavity.

14. The aerosol-generating device according to claim 1, wherein the cover moving element is configured to automatically open or close the at least one upstream opening.

15. The aerosol-generating device according to claim 1, wherein the at least one upstream opening forms an air inlet.

16. The aerosol-generating device according to claim 1, wherein the at least one upstream opening forms a plurality of air inlets in the aerosol-generating device.

17. An aerosol-generating system, comprising an aerosol-generating device according to claim 16 and one or both of: an aerosol-generating article comprising aerosol-forming substrate, and a cleaning article.

18. A method for operating the aerosol-generating system of claim 17, the method comprising:

moving the movable downstream cover from the downstream opening; and inserting the article into the cavity, wherein the cover moving element moves the movable upstream cover from the at least one upstream opening upon one or both of: moving of the movable downstream cover or insertion of the article into the cavity.

19. The method according to claim 18, further comprising:

removing the article from the cavity; and moving the movable downstream cover over the downstream opening, wherein the cover moving element moves the movable upstream cover over the at least one upstream opening upon one or both of: moving of the movable downstream cover and removal of the article from the cavity.

20. A method for operating the aerosol-generating system of claim 17, the method comprising:

removing the article from the cavity, wherein the cover moving element moves the movable upstream cover over the at least one upstream opening, and wherein the cover moving element moves the movable downstream cover over the downstream opening upon removal of the article from the cavity.

* * * * *